United States Patent [19]

Zinger et al.

[11] Patent Number: 4,665,933

[45] Date of Patent: May 19, 1987

[54] HAIR COLOR TIERS

[76] Inventors: John E. Zinger; Joanne Zinger, both of R.D. #1, Box 1231, Orwigsburg, Pa. 17961

[21] Appl. No.: 910,741

[22] Filed: Sep. 23, 1986

[51] Int. Cl.[4] ..... A45D 1/00

[52] U.S. Cl. ..... 132/9; 132/45 R

[58] Field of Search ..... 132/9, 45 R, 144, 7

[56] References Cited

U.S. PATENT DOCUMENTS

| | | | |
|---|---|---|---|
| 1,457,257 | 5/1923 | McLaughlin | 132/45 R X |
| 1,639,804 | 8/1927 | Lewis | 132/45 R |
| 2,558,516 | 6/1951 | Granberg | 132/45 R |
| 2,595,564 | 5/1952 | Budd | 132/45 R X |
| 2,949,920 | 8/1960 | Humphrey | 132/45 R |
| 3,126,015 | 3/1964 | Sidelman | 132/54 X |
| 3,586,009 | 6/1971 | Sirmons | 132/9 |

*Primary Examiner*—Gregory E. McNeill

*Attorney, Agent, or Firm*—Leonard M. Quittner

[57] ABSTRACT

A system of dyeing human hair is disclosed which is performed by layering the hair in tiers and selectively dyeing each layer. The tiers are annular elipsoids whose major and minor axes are in the same ratio and are fabricated in sets of ascending size. Each tier has disposed along its inner circumference, evenly spaced comb tooth-like projections.

3 Claims, 4 Drawing Figures

HAIR COLOR TIERS

CROSS-REFERENCE

There are no cross-references to nor are there any related applications.

FEDERALLY SPONSORED RIGHTS

The invention herein was made without any Federal sponsorship or contribution.

BACKGROUND OF THE INVENTION

1. The Field of the Invention

The field of the invention relates generally to beauty products and particularly to an improved method of human hair coloring by a hair stylist and a device which facilitates said coloring.

2. Description of the Prior Art

The prior art is best demonstrated by U.S. Pat. No. 2,781,048 to LeDonne showing table-like layers or tiers to fit over the head as a hair cutting guide but are not suitable for the present invention's purposes. The tabs (See nos. 23–26) incorporate a refinement for measurement of the hair for cutting but serve no other function nor can they. An older treatment of problems created by hair dyeing is likewise addressed in U.S. Pat. No. 2,347,587 to Wiles. U.S. Pat. No. 3,586,009 to Sirmons shows a skull cap arrangement useful in hair frosting, or the selective coloring of groupings or hanks of hair to be rendered in identical color.

The balance of the art (as demonstrated, inter alia, in U.S. Pat. Nos. 1,593,042 to Streuli, 1,806,155 to Farrelly, 1,858,331 to Hughes, 2,136,039 to Clancy, 2,226,956 to Womack, 2,327,678 and 2,447,215 both to Stovall, 2,447,776 to Sherwood, 2,599,152 to Bartfay, 3,319,262 to Lee, 3,611,442 to Yazari, and 4,441,214 to Werner), all deal with single tiers, brims or dams and the like, the essential purpose of which is to protect the face and ears during shampooing or hair drying and setting wherein a stream of hot air is directed against the head.

U.S. Pat. No. 2,599,152 to Bartfay shows a single annular brim which is split for adjustment and fitted with elastic material on its inner margin to prevent seepage of liquid applied to the hair for setting. The construction and purpose does not permit utilization of more than one (1) layer and the configuration disclosed is not adaptable to nor does it teach toward the coloring technique utilizing multiple layers of tiers disclosed herein. The shield of U.S. Pat. No. 4,441,214 to Werner discloses an enclosed system for application of liquids to hair for various purposes and is not suitable for the purposes set forth in this present invention since it does not permit selective dyeing.

None of the foregoing prior art incorporates the novel features of the present invention nor do they accomplish the same purpose.

SUMMARY OF THE INVENTION

Heretofore, the dyeing of hair was a skill which required the extensive training of a hair stylist to create a natural look to the client's hair. A uniform color is both unnatural looking and general deemed unfashionable. The ability, for example, to duplicate the effect of sunlight wherein a lighter color exists at the very top of the head and shades off to darker hues as the hair lengthens, is difficult to learn and takes years of practice to duplicate.

Also, the accomplished hair stylist is limited by the random growth of hair in the coloring thereof to create new and acceptable color effects. The present invention provides great flexibility and creativity to the stylist who needs a minimum of training and skill to practice the invention.

The process of the invention described herein is summarized by a hair stylist installing on a human head commencing with the lower most portion of the hair to be dyed, new and novel annular elipsoidal shaped tiers or masks made from sheets of a flexible, but somewhat rigid material such as low density polyethylene, each tier a defined distance apart in ascending order, each successive tier being smaller but no greater than equal to the previous one.

The product of the invention is a planar elipsoidal annular tier which has formed along its inner circumference, evenly spaced, a multiplicity of comb tooth-like projections directed inward toward the center of the tier to hold the tier in place by a comb effect against the scalp. The tiers are used in sets in ascending order on the head but in descending size. Each is constructed by using the same mathematical ratio of minor to major axis. Typically a ratio of 0.885 elipticity of the inner circumference has proven satisfactory for proper fit.

Selective dyeing takes place layer by layer to enable the stylist to vary the shades of color so as to create a natural effect or to create a different color in any layer.

An object of the invention is to provide a simple system of hair dyeing which minimizes the skill of the stylist but which yields a most natural look to the dyed hair when the process is completed than by current methods of free hand application of the dyeing paste.

A further object of the invention is to eliminate intermixing of dyeing pastes of different color when applied to different layers of hair.

A further object of the invention is to provide means by which novel color effects can be created in the dyeing of hair, or relaxing or straightening the same.

Other objects, advantages and features of the present invention will be apparent to those skilled in the art from the following description taken in conjunction with the accompanying drawings.

DESCRIPTION OF DRAWINGS

The present invention may be better understood by reference to the drawings wherein four (4) figures are shown on one (1) sheet. The numbers shown on the drawings for the various parts of the invention are consistent throughout so that a number indicating a part in one drawing will indicate the same part in another drawing.

Figure 1:
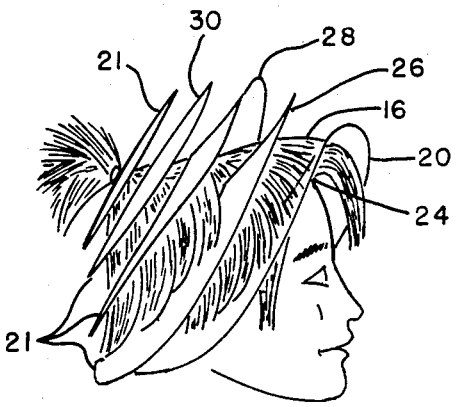
FIG. 1 shows a side perspective view of a human head with an array of tiers installed thereon.
Figure 2:
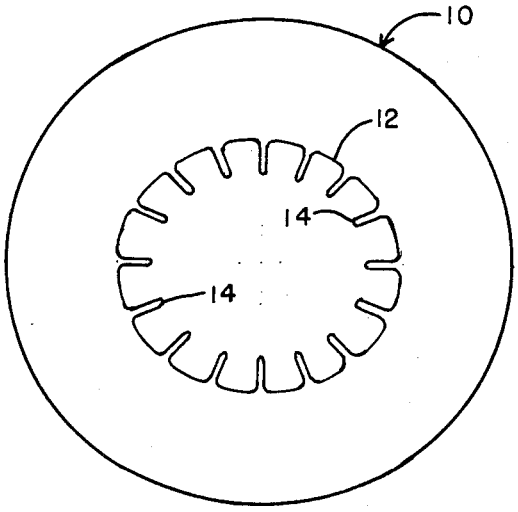
FIG. 2 shows a plan view of a typical tier.

DESCRIPTION OF THE PREFERRED EMBODIMENT a. The Product

The preferred embodiment is described as comprising a set of tiers of different sizes, each of planar elipsoidal annular shape (10), made from a sheet of plastic material whose characteristics are flexibility with some rigidity.

Substances such as low density polyethylene approximately 0.060 inches thick, provide satisfactory results in construction and use. An elipticity of the inner circumference with a ratio of 0.880 minor to major axis provides a proper fit.

Each tier has disposed evenly spaced along its inner circumference (12) comb tooth-like projections (14) of a defined length which are designed to engage the hair (16) near the scalp (17) by bending upward curvilinearly (18) and flixing to follow the scalp to hold the tier firmly in any location selected by the stylist as the tier is brought downward on the head as far as its inner circumference will permit (20). The tiers are placed on the head successively in an array in ascending order (21) but in at maximally equal or preferably descending circumference to create a multi-layered hair dyeing surface.

b. The Process

Figure 3:
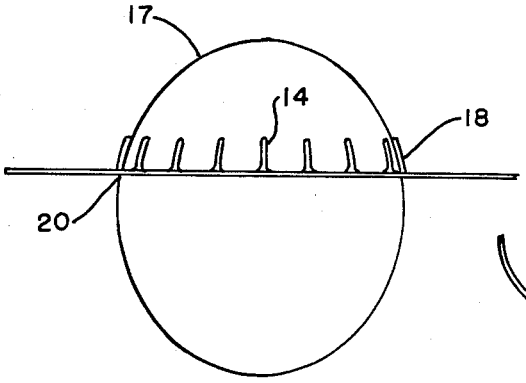
FIG. 3 shows a head in outline with one tier installed.

The process is best described as a series of steps. The first step is installing on a human head a first tier of a large size from a set of tiers made in accordance with the preferred embodiment of the product herein such that the major axis of the tier is in line with the centermost vertical plane of the head (See FIG. 3) nasocranially and such that the tier is lowered in snug contact with the head to a line coincident to approximately the hair line (24). Next the stylist installs on the head in identical alignment a second next largest tier (26) (or one which is in its inner circumference no greater than the first) a defined distance from the first tier thereby creating a layer of hair. Thereafter the stylist repeats the second step with additional successively smaller tiers (28, 30) as required thereby creating a multiplicity of hair layers until the head has installed thereon a sufficient number of tiers and layers as determined by the stylist.

Figure 4:
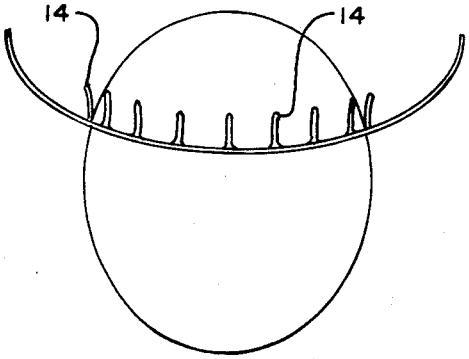
FIG. 4 shows a head in outline with the tier fixed for removal.

Although the stylist may vary the time at which dye is applied in any one layer, the stylist preferably commences coloring the lowermost layer of hair by applying thereto a dye paste mixture with a defined dyeing time and of a color shade selected or mixed by the stylist. Thereafter the content of the dye paste mixture may be altered to create a different shade or color to the next lowermost layer of hair from that previously applied. This process is repeated until all the layers have applied thereto dye paste mixtures. After waiting the defined dyeing time the hair is rinsed and the tiers removed by flexing them upwardly thereby disengaging the teeth (see FIG. 4). This is done in descending order whereupon the hair is combed, dried and set by the stylist in accordance with practices well known in the prior art.

Since modifications, variations and changes in detail may be made to the presently described embodiments, it is intended that all matter in the foregoing description and accompanying drawings be interpreted as illustrative and not by way of limitation.

What is claimed is:

1. A human hair dyeing tier comprising an planar elipsoidal annulas made of flexible material which has disposed evenly spaced along its inner circumference comb tooth-like projections inwardly directed a defined distance.

2. A hair dyeing tier as in claim 1 which is made of low density polyethylene of 0.060 inches thickness.

3. A hair dyeing tier as in claim 1 wherein the elipticity ratio of the inner circumference is 0.885, minor to major axis.

* * * * *